US005329866A

United States Patent [19]

LaRue

[11] Patent Number: 5,329,866

[45] Date of Patent: Jul. 19, 1994

[54] COMBINED LOW $NO_x$ BURNER AND $NO_x$ PORT

[75] Inventor: Albert D. LaRue, Uniontown, Ohio

[73] Assignee: The Babcock & Wilcox Company, New Orleans, La.

[21] Appl. No.: 116,312

[22] Filed: Sep. 3, 1993

[51] Int. Cl.[5] ..... F23D 1/00

[52] U.S. Cl. ..... 110/265; 110/263; 110/264; 431/181; 431/190

[58] Field of Search ..... 110/263, 264, 265, 347, 110/349; 431/190, 181

[56] References Cited

U.S. PATENT DOCUMENTS

| | | | |
|---|---|---|---|
| 4,520,739 | 6/1985 | McCartney et al. | 110/263 |
| 5,195,450 | 3/1993 | Marion | 110/347 |
| 5,205,226 | 4/1993 | Kitto, Jr. et al. | 110/264 |
| 5,231,937 | 8/1993 | Kobayashi et al. | 110/263 X |

*Primary Examiner*—Edward G. Favors

*Attorney, Agent, or Firm*—Robert J. Edwards; Eric Marich

[57] ABSTRACT

A burner and port combination for the combustion of a pulverized coal fuel plus air mixture comprises a throat and a burner nozzle positioned at a central area of the throat. The burner nozzle has an inlet for receiving the pulverized coal fuel plus air mixture and an outlet for discharging the pulverized coal fuel plus air mixture. A secondary air tube is positioned laterally adjacent the burner nozzle at each lateral side of the nozzle in the throat for providing a first portion of a secondary air to the throat. A plurality of vanes are positioned at an upper portion of the throat above the burner nozzle and the tubes and at a lower portion of the throat below the burner nozzle tubes for deflecting a second portion of the secondary air from the burner nozzle.

8 Claims, 3 Drawing Sheets

COMBINED LOW $NO_x$ BURNER AND $NO_x$ PORT

FIELD AND BACKGROUND OF THE INVENTION

The present invention relates in general to fuel burners and in particular to a new and useful combined burner and $NO_x$port for burning fossil fuels.

Low $NO_x$ pulverized coal-fired burners, such as the burner disclosed by U.S. Pat. No. 5,199,355, rely on principles of air and fuel staging to reduce emissions of $NO_x$. The effectiveness of these measures depends upon the design of the burners and the furnace to which they are applied, amongst other factors. In order to further reduce $NO_x$ emissions, $NO_x$ports (over fire air ports, air staging ports) are employed in order to remove a portion of the air from the burners for introduction downstream in the combustion process.

In typical wall fired utility boiler applications, the burners are arranged in multiple elevations on the front and/or rear wall of the lower furnace. Low $NO_x$ burners are installed at these locations for new boilers, or retrofitted to existing boilers. For a given application, the actual $NO_x$ emissions from these burners vary across the height of the burner zone due to the changing thermal environment. The bottom elevation of the burners resides in the coolest portion of the furnace and produces the lowest $NO_x$ emissions. The top elevation of the burners produces the highest $NO_x$ since temperatures in the furnace at that location are reaching a maximum. This contributes to the formation of thermal $NO_x$.

In addition, the upward flow of gases from the lower burner elevations impinge on the flames of the upper burners, accelerating the mixing of air and fuel, which contributes to fuel $NO_x$. These effects are documented in numerous tests of boilers, which show that removing the top row of burners from service reduces $NO_x$, while removing the bottom row of burners from service increases $NO_x$ (compared to all burners in service). $NO_x$ ports have become necessary to achieve $NO_x$ emission objectives. $NO_x$ ports are normally positioned above the top burner elevation; and the effectiveness of the $NO_x$ ports is a function of how much air is diverted from the burners to the ports, and the distance from the burners to the ports. However, in many existing boilers it is difficult to find a suitable location above the burners to locate the ports. The height of the furnace or arrangement of the heating surface or the auxiliary equipment prevents the addition of ports above the burners.

SUMMARY OF THE INVENTION

The present invention provides for a burner and port combination for the combustion of a pulverized coal fuel plus air mixture comprising a throat and a burner nozzle positioned at a central area of the throat. The burner nozzle has an inlet for receiving the pulverized coal fuel plus air mixture and an outlet for discharging the pulverized coal fuel plus air mixture. A secondary air tube is positioned laterally adjacent to the burner nozzle at each lateral side of the nozzle in the throat in order to provide a first portion of a secondary air to the throat. A plurality of vanes are positioned at an upper portion of the throat above the burner nozzle and the tubes and at a lower portion of the throat below the burner nozzle and the tubes for deflecting a second portion of the secondary air from the burner nozzle.

The present invention also provides for a burner and port combination having a burner nozzle and laterally positioned secondary air tubes at a lower portion of the throat for providing a first portion of a secondary air and a plurality of vanes positioned at an upper portion of the throat above the burner nozzle and the tubes in order to deflect a second portion of the secondary air from the burner nozzle.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

The present invention pertains to combining the function of burners and $NO_x$ ports for the upper elevations of burners in wall-fired furnaces. The present invention allows for lower $NO_x$ emissions for a combustion system since the burners are low $NO_x$, in themselves, while also serving as $NO_x$ ports for lower burners.

Figure 1A:
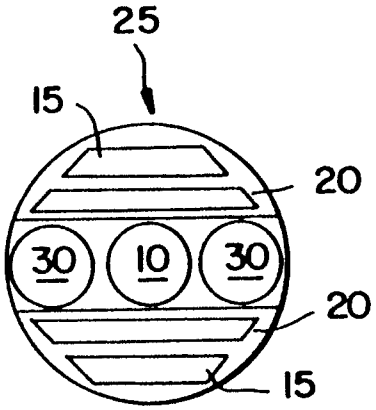
FIG. 1*a* is a front view of FIG. 1.
Figure 1:
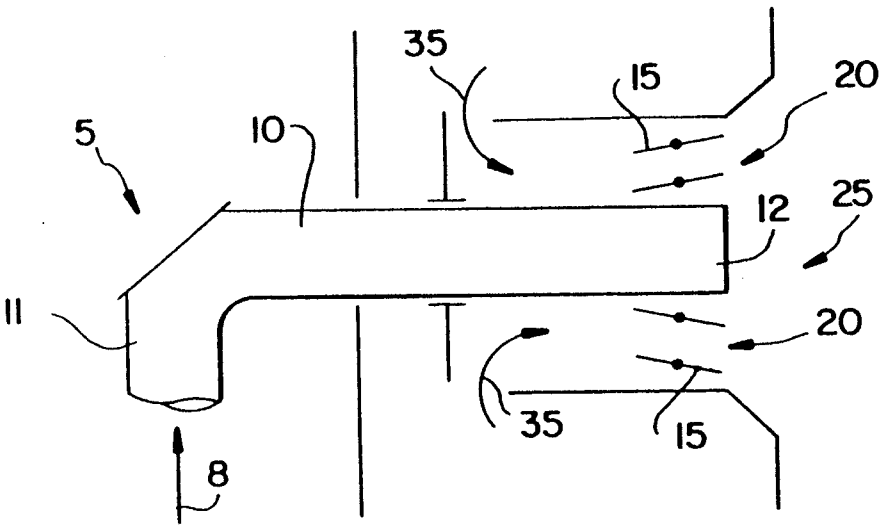
FIG. 1 is a schematic representation of one embodiment of the present invention.
Figure 3:
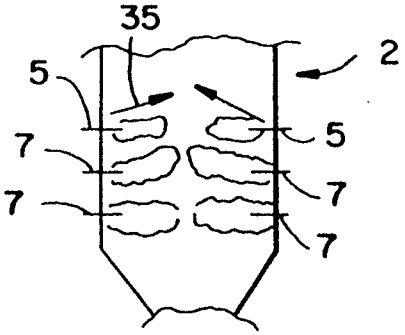
FIG. 3 is a schematic representation of a furnace employing the present invention.

According to the present invention, FIG. 1 shows a combined low $NO_x$ burner/$NO_x$ port (CBP) 5 having a burner nozzle 10 for supplying a pulverized coal (PC) and primary air (PA) mixture 8. The PA/PC mixture 8 is received through an inlet 11 and injected into a furnace 2 (FIG. 3) at an outlet 12 of the nozzle 10. A swirler is positioned inside of the nozzle near the outlet 12 (conventional and not shown) in order to facilitate air/fuel mixing and stability at the burner 10. The nozzle 10 is positioned at a central area of a throat 25. Tubes 30 (FIG. 1*a*) are positioned laterally adjacent the nozzle 10 on each side of nozzle 10 in order to supply a small portion of a secondary air 35 adjacent to the nozzle 10 for rapidly mixing with the PA/PC mixture 8 for purposes of ignition and stabilization. The combined stoichiometry from the nozzle 10 and tubes 30 is about 0.50, that is, 50% of theoretical air. The secondary air 35 introduced from the tubes 30 is swirled in order to increase mixing with the PA/PC mixture 8, and to entrain nearby hot furnace gases produced from the burner flames which are lower in the furnace 2 (FIG. 3). Alternately, air jets without swirl can be emitted from the tubes 30 in order to entrain nearby hot gases for mixing with the PA/PC mixture 8.

The amount of air swirl varies depending upon the coal reactivity and the furnace design. Experience with deep staged reburn burners in a cyclone feburn program substantiate that PC flames can be stabilized at stoichiometries of 0.50 in the presence of a hot furnace environment (in that case produced by cyclones in the lower furnace rather than other burners). The very low stoichiometry effectively reduces $NO_x$ formation on these top burners, which otherwise would produce more $NO_x$ than the other burners. The very low stoichiometry of the CBP 5 simulates reburning systems, and potentially provides reburning (fuel staging) $NO_x$ reduction as fuel radicals from the CBP mix with the furnace gases regenerated from lower burners 7 as shown in FIG. 3.

FIG. 1 shows that the remaining secondary air 35 is admitted through a plurality of vanes 15, which are located below the nozzle 10 and the tubes 30 at ports 20, and which deflect the air 35 away from the burner 5. The quantity of secondary air 35 through the vanes 15 includes the balance of theoretical and excess air for the respective burner 5, along with some air diverted from the lower elevation burners 7 (FIG. 3).

The inherent lower air resistance of the CBP 5 facilitates the increasing of the secondary air flow 35 beyond the quantities used in the lower burners 7 (FIG. 3). In addition, the vanes 15 can be curved vanes in order to reduce the resistance through the CBP 5. Beyond this, the dampers or registers of the lower burners 7 (FIG. 3) can be throttled in order to increase the air resistance and force additional air through the CBP's 5. The momentum of this air will delay its mixing with the flame originating at the CBP 5, limiting $NO_x$ formation while providing energy for the mixing with the gases further out into the furnace 2 in order to complete combustion. Even though large quantities of secondary air 35 are introduced through the CBP 5, the present invention separates the majority of this air 35 from the early stages of coal combustion at the CBP throat 25. Therefore, $NO_x$reduction is achieved by virtue of the very low stoichiometry of the flame generated at the CBP throat 25, and by diverting air from the lower burners 7 to the CBP's 5, as shown in FIG. 3, serves as an $NO_x$ port 20 (FIG. 1) for the lower burners 7. This is accomplished without the need for separate $NO_x$ ports, which may be impractical, or which would increase the cost and the complexity of the system.

FIGS. *2a* and *2b* show a second embodiment of the CBP 5. As illustrated in FIGS. *2a* and *2b*, the burner nozzle 10 is located at a bottom portion of the burner throat 25 in a partitioned segment of the throat 25. The PA/PC mixture 8 is swirled near the exit 12 (FIG. 2)of the nozzle 10 in order to increase the mixing for purposes of flame stability. Tubes 30 (FIG. *2a*) are positioned adjacent to the nozzle 10 for injecting a small portion of the secondary air 35 for producing a combined stoichiometry of 0.50 for the PA/PC mixture 8. Again, the air 35 can be swirled or alternately injected as a jet, in a manner to induce rapid mixing with the PA/PC mixture 8 and nearby gases, in order to stabilize the flame. The remainder of the secondary air 35 is admitted through an upper portion of the burner at the port 20 through vanes 15 positioned in the port 20 for deflecting the air 35 away from the burner 5. The vanes 15 are tilted in order to deflect the air 35 higher into the furnace 2 (FIG. 3) for delaying the mixing and more effectively serving as $NO_x$ ports 20. The secondary air 35 includes the remaining portion required for the CBP 5 along with some air diverted away from the lower burners 7.

The CBP 5, according to the present invention, results in low $NO_x$ emissions from the upper burner elevations which otherwise produce the highest $NO_x$, while serving as $NO_x$ ports 20 for the lower burners which further reduces $NO_x$. This is accomplished without requiring the complication or expenses of adding separate $NO_x$ ports. The CBP 5 provides a means of reducing overall $NO_x$ emissions for a pulverized coal fired combustion system by taking advantage of the conditions existing in wall fired units. The hotter thermal environment in the upper burner zone, which otherwise increases $NO_x$ production, is used as a flame stabilizing source for an unconventional burner design. The hot gases promote flame stability at very low burner stoichiometry.

The CBP 5 acts as a reburner with nozzle 10 and tubes 30. This permits use of the remainder of the burner throat 25 as a $NO_x$ port 20. Additional high velocity secondary air 35 is injected into the furnace 2 and deflected away from the CBP flame by vanes 15 in order to maintain its low stoichiometry. This deflected high velocity secondary air 35 goes on to effectively mix with the furnace gases for completing combustion similar to traditional $NO_x$ ports. When the fuel is shut off to the CBP's 5 (with the corresponding pulverizer out of service), the CBP 5 functions solely as a $NO_x$port for the lower burner elevations.

Figure 4:
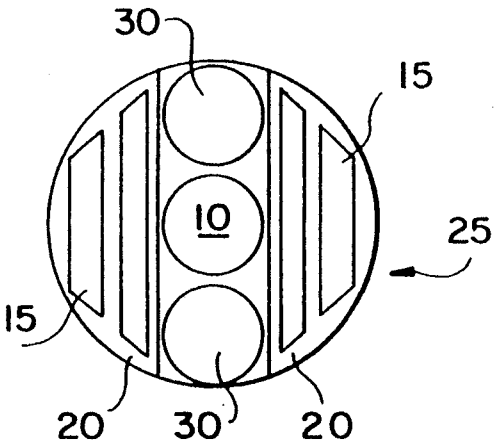
FIG. 4 is a front view of a third embodiment of the present invention.

Other variations of the CBP 5 are also practical. An alternative to the design illustrated in FIGS. 1 and 1*a* is to rotate the CBP 90 degrees, as shown in FIG. 4, such that the tubes 30 are adjacent to the nozzle 10 but only above and below the nozzle 10 with the vanes 15 deflecting air 35 horizontally from the flame. This would be beneficial for burners adjacent to the sidewall of the furnace, in order to protect the sidewall from corrosion or slagging by directing air along it.

Figure 2A:
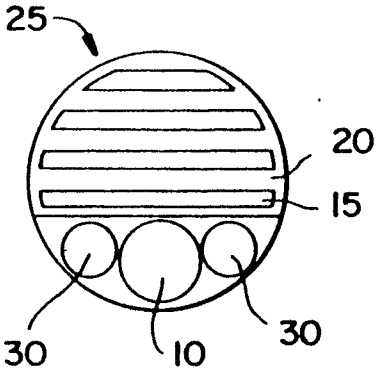
FIG. 2*a* is a front view of FIG. 2.
Figure 2:
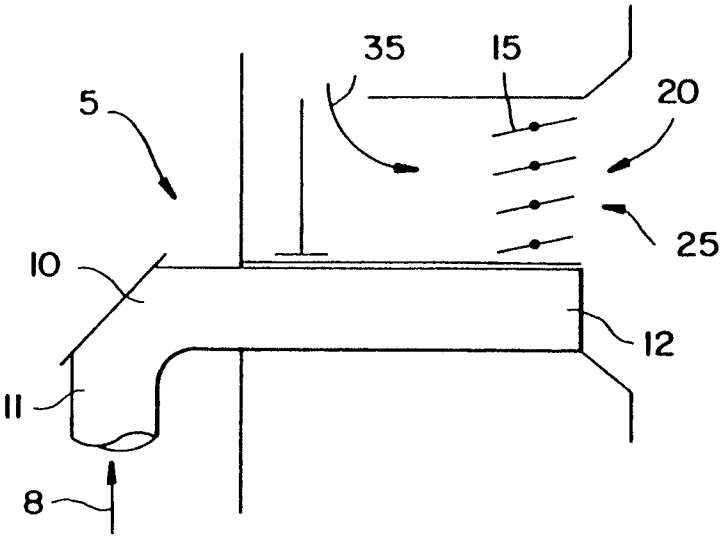
FIG. 2 is a schematic representation of a second embodiment of the present invention.
Figure 5:
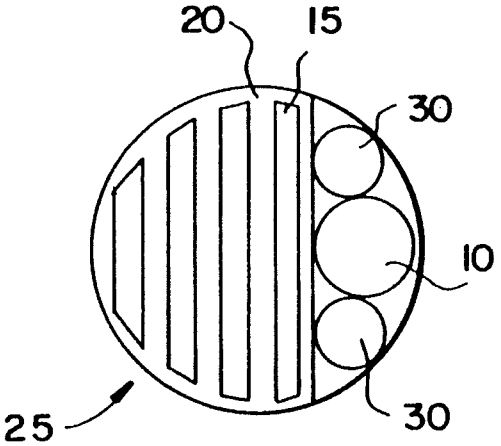
FIG. 5 is a front view of a fourth embodiment of the present invention.

Another alternative to the embodiment of FIG. 2 and *2a* is to rotate the CBP 90 degrees, as shown in FIG. 5, such that the burner nozzle 10 is on the horizontal centerline at the edge of the throat 25 with the air tubes 30 adjacent to it, and with the air vanes 15 directing air horizontally away from the flame. Again, this would be beneficial for burners adjacent to sidewalls by directing air along the sidewall to prevent slagging or corrosion.

Another alternative involves the introduction of the coal through the burner nozzle. Although reburning tests have shown the benefit of swirling coal for flame stability at very low stoichiometries, this may not be necessary with some reactive coals. The coal would be introduced as an axial jet, tending to further reduce $NO_x$.

Another alternative would be to change the shape of the coal nozzle near the outlet from circular to rectangular in order to better fit the segment or portion of the burner throat in which it resides. The air tubes could similarly be reshaped to better fit the cavity adjacent to the coal nozzle. In either case, the air tubes could be equipped with vanes to deflect the air toward the fuel jet to accelerate mixing, rather than using swirling air as previously described.

An alternative to the air tubes 30 as shown in FIGS. 1*a* and *2a* would be to use a bluff body on the outside of the burner nozzle and admit air axially into the cavity adjacent to the nozzle where the tubes are shown, without using the tubes per se. Mixing of this air with the PA/PC mixture would be accomplished by the turbulence of the air over the bluff body.

Another alternative is to use CBP's at multiple elevations of burners to enhance $NO_x$ reduction, rather that just at the top burner elevation. Elevated furnace temperatures in the burner zone and high coal reactivity could support two or more elevations of CBP's with satisfactory flame stability.

Another alternative is to use fuels other than pulverized coal. The coal nozzle can be equipped with an oil atomizer to enable oil firing with the CBP. Oil combustion would be facilitated by the use of grouped-hole sprayer tips, which produce a "butterfly" or rectangular flame, more compatible with the design of the CBP. Natural gas can be fired through a gas element located inside the coal nozzle, in place of the oil atomizer, or alternately, by multiple spuds in the cavity adjacent to the coal nozzle and through or between the air tubes. Gas firing would be facilitated by directional spuds to pattern the gas flame to be compatible with the CBP, similar to oil firing.

A final alternative is to use actual $NO_x$ ports positioned above the CBP's, for a second level of air staging for further reducing $NO_x$. That is, the CBP does not eliminate the potential for additional air staging for situations which would accommodate this and require the lowest level of $NO_x$emissions.

While a specific embodiment of the invention has been shown and described in detail to illustrate the application of the principles of the invention, it will be understood that the invention may be embodied otherwise without departing from such principles.

What is claimed is:

1. A burner and port combination for the combustion of a pulverized coal fuel plus air mixture, the burner and port combination comprising:

a throat;

a burner nozzle positioned at a central area of the throat, the burner nozzle having an inlet for receiving the pulverized coal fuel plus air mixture and an outlet for discharging the pulverized coal fuel plus air mixture;

a secondary air tube positioned laterally adjacent the burner nozzle at each lateral side of the nozzle in the throat for providing a first portion of a secondary air to the throat; and a plurality of vanes positioned at an upper portion of the throat above the burner nozzle and the tubes and at a lower portion of the throat below the burner nozzle and the tubes for deflecting a second portion of the secondary air in the throat from the burner nozzle.

2. The burner and port combination according to claim 1, wherein the burner nozzle and the tubes maintain a burner stoichiometric ratio of approximately 0.50.

3. The burner and port combination according to claim 1, wherein the combination is located at an upper level of a combustor.

4. The burner and port combination according to claim 1, wherein the throat is circular-shaped.

5. A burner and port combination for the combustion of a pulverized coal fuel plus air mixture, the burner and port combination comprising:

a throat;

a burner nozzle positioned at a lower area of the throat, the burner nozzle having an inlet for receiving the pulverized coal fuel plus air mixture and an outlet for discharging the pulverized coal fuel plus air mixture;

a secondary air tube positioned laterally adjacent the burner nozzle at each lateral side of the nozzle in the throat for providing a first portion of a secondary air to the throat; and a plurality of vanes positioned at an upper portion of the throat above the burner nozzle and the tubes for deflecting a second portion of the secondary air from the burner nozzle.

6. The burner and port combination according to claim 5, wherein the burner nozzle and the tubes maintain a burner stoichiometric ratio of approximately 0.50.

7. The burner and port combination according to claim 5, wherein the combination is located at an upper level of a combustor.

8. The burner and port combination according to claim 5, wherein the throat is circular-shaped.

* * * * *